US008261673B2

(12) United States Patent
Ingham

(10) Patent No.: US 8,261,673 B2
(45) Date of Patent: Sep. 11, 2012

(54) PALLET WITH LEAD BOARD

(75) Inventor: Terry L. Ingham, Oxford, MI (US)

(73) Assignee: Fitzpatrick Technologies, Oxford, MI (US)

( * ) Notice: Subject to any disclaimer, the term of this patent is extended or adjusted under 35 U.S.C. 154(b) by 16 days.

(21) Appl. No.: 12/679,160

(22) PCT Filed: Sep. 26, 2008

(86) PCT No.: PCT/US2008/077865

§ 371 (c)(1), (2), (4) Date: Mar. 19, 2010

(87) PCT Pub. No.: WO2009/042872

PCT Pub. Date: Apr. 2, 2009

(65) Prior Publication Data

US 2010/0229764 A1 Sep. 16, 2010

Related U.S. Application Data

(60) Provisional application No. 60/995,492, filed on Sep. 26, 2007, provisional application No. 60/998,913, filed on Oct. 12, 2007.

(51) Int. Cl.
*B65D 19/00* (2006.01)

(52) U.S. Cl. ..... 108/51.11; 108/57.25; 108/57.17

(58) Field of Classification Search ..... 108/57.25, 108/57.17, 51.11, 90, 902, 57.28, 57.281; 248/346.02

See application file for complete search history.

(56) References Cited

U.S. PATENT DOCUMENTS

| | | | | | |
|---|---|---|---|---|---|
| 2,503,022 | A | * | 4/1950 | Benoist et al. | 108/57.17 |
| 2,651,486 | A | * | 9/1953 | Woodward | 108/57.1 |
| 2,817,485 | A | * | 12/1957 | White et al. | 108/57.1 |
| 2,823,883 | A | * | 2/1958 | Bourdon | 108/57.1 |
| 2,919,090 | A | | 12/1959 | De Pew | |
| 2,967,036 | A | * | 1/1961 | Phillips | 108/57.1 |
| 3,104,085 | A | | 9/1963 | Skladany | |
| 3,204,583 | A | | 9/1965 | Nicholson | |
| 3,645,215 | A | | 2/1972 | Kirkpatrick | |
| 3,769,127 | A | | 10/1973 | Goldsworthy et al. | |
| 4,226,192 | A | | 10/1980 | Myers | |

(Continued)

FOREIGN PATENT DOCUMENTS

DE 4026786 A1 2/1992

(Continued)

OTHER PUBLICATIONS

International Preliminary Report on Patentability for PCT/US2008/077865 (Sep. 26, 2008).

(Continued)

*Primary Examiner* — Jose V Chen

(74) *Attorney, Agent, or Firm* — Harness, Dickey & Pierce, P.L.C.

(57) ABSTRACT

A pallet having an upper deck and a lower deck secured by supporting block members. The upper deck may include a plurality of board members and may be provided with at least one lead board operable to serve as an energy attenuator. The lead board may comprise a composite material and may be formed using pultrusion techniques. The lead board may be separated or spaced from an adjacent board member by a gap or scallop type area and may be operable to flex inwardly or otherwise upon impact to absorb energy. The gap or scallop type area may be suitable to operate in combination with the lead board as a handle mechanism for grabbing or lifting the pallet. The lead board may also be used to attach shipping straps.

17 Claims, 5 Drawing Sheets

U.S. PATENT DOCUMENTS

| | | | | | |
|---|---|---|---|---|---|
| 4,240,358 | A | | 12/1980 | Munroe | |
| 4,261,470 | A | | 4/1981 | Dolan | |
| 4,325,899 | A | | 4/1982 | Cole et al. | |
| 4,385,564 | A | | 5/1983 | Heggenstaller | |
| 4,439,387 | A | | 3/1984 | Hawley | |
| 4,451,528 | A | | 5/1984 | Krause | |
| 4,488,862 | A | | 12/1984 | Epel et al. | |
| 4,535,110 | A | | 8/1985 | Iseler et al. | |
| 4,551,085 | A | | 11/1985 | Epel et al. | |
| 4,612,149 | A | | 9/1986 | Iseler et al. | |
| 4,622,324 | A | | 11/1986 | Klessing et al. | |
| 4,715,294 | A | | 12/1987 | Depew | |
| D301,079 | S | * | 5/1989 | DePew | D34/38 |
| 4,855,097 | A | | 8/1989 | Iseler et al. | |
| 4,865,202 | A | | 9/1989 | Day | |
| 4,867,924 | A | | 9/1989 | Schilkey et al. | |
| 5,076,175 | A | * | 12/1991 | Whatley, II | 108/51.11 |
| 5,130,071 | A | | 7/1992 | Iseler et al. | |
| 5,175,692 | A | | 12/1992 | Mazouz et al. | |
| 5,191,843 | A | | 3/1993 | Ausavich et al. | |
| 5,249,917 | A | | 10/1993 | Neumann et al. | |
| 5,294,384 | A | | 3/1994 | David et al. | |
| 5,297,485 | A | | 3/1994 | Bond | |
| 5,298,098 | A | | 3/1994 | Hoedl | |
| 5,337,681 | A | | 8/1994 | Schrage | |
| 5,351,628 | A | | 10/1994 | Breezer et al. | |
| 5,370,521 | A | | 12/1994 | McDougall | |
| 5,402,735 | A | | 4/1995 | DeJean | |
| 5,417,167 | A | * | 5/1995 | Sadr | 108/57.19 |
| 5,441,154 | A | | 8/1995 | Youell, III | |
| 5,558,745 | A | | 9/1996 | Conway et al. | |
| 5,660,427 | A | | 8/1997 | Freeman et al. | |
| 5,673,629 | A | * | 10/1997 | Ginnow | 108/57.17 |
| 5,687,652 | A | * | 11/1997 | Ruma | 108/57.25 |
| 5,720,229 | A | | 2/1998 | Schrage | |
| 5,756,017 | A | | 5/1998 | Togawa et al. | |
| 5,836,255 | A | | 11/1998 | Uitz | |
| 5,851,469 | A | | 12/1998 | Muller et al. | |
| 5,868,080 | A | * | 2/1999 | Wyler et al. | 108/57.25 |
| 5,921,189 | A | | 7/1999 | Estepp | |
| 5,931,435 | A | | 8/1999 | Hoadley et al. | |
| 5,960,721 | A | * | 10/1999 | Huetteman et al. | 108/57.17 |
| 6,021,721 | A | | 2/2000 | Rushton | |
| 6,112,672 | A | * | 9/2000 | Heil | 108/55.3 |
| 6,192,807 | B1 | * | 2/2001 | Mason | 108/51.11 |
| 6,199,488 | B1 | | 3/2001 | Favaron et al. | |
| 6,216,608 | B1 | | 4/2001 | Woods et al. | |
| 6,234,086 | B1 | | 5/2001 | Mason | |
| 6,237,509 | B1 | | 5/2001 | Ishido et al. | |
| 6,251,323 | B1 | | 6/2001 | Hoedl et al. | |
| 6,283,044 | B1 | | 9/2001 | Apps | |
| 6,352,039 | B1 | * | 3/2002 | Woods et al. | 108/57.25 |
| 6,386,118 | B1 | | 5/2002 | Bendit et al. | |
| 6,389,990 | B1 | | 5/2002 | Apps | |
| 6,422,405 | B1 | | 7/2002 | Haenszel | |
| 6,448,307 | B1 | | 9/2002 | Medoff et al. | |
| 6,508,182 | B1 | | 1/2003 | Smorgan et al. | |
| 6,524,426 | B1 | * | 2/2003 | St. John et al. | 156/309.6 |
| 6,560,840 | B1 | | 5/2003 | Jenkins et al. | |
| 6,564,725 | B2 | | 5/2003 | Hale | |
| 6,586,504 | B1 | | 7/2003 | Archuletta et al. | |
| 6,622,641 | B2 | | 9/2003 | Smyers | |
| 6,622,642 | B2 | | 9/2003 | Ohanesian | |
| 6,632,387 | B2 | | 10/2003 | Archuletta et al. | |
| 6,644,219 | B2 | | 11/2003 | Apps | |
| 6,651,799 | B1 | | 11/2003 | Rice et al. | |
| 6,659,020 | B1 | | 12/2003 | Ball | |
| 6,668,735 | B2 | | 12/2003 | Cassina | |
| 6,708,629 | B2 | * | 3/2004 | Dumouchel | 108/57.25 |
| 6,748,876 | B2 | | 6/2004 | Preisler et al. | |
| 6,837,170 | B2 | * | 1/2005 | Taft | 108/57.25 |
| 6,838,148 | B1 | | 1/2005 | Ehnert et al. | |
| 6,874,428 | B2 | | 4/2005 | Apps | |
| 6,938,558 | B1 | | 9/2005 | Peres | |
| 6,955,128 | B2 | | 10/2005 | Apps | |
| 7,219,609 | B1 | * | 5/2007 | Utz et al. | 108/57.21 |
| 7,607,628 | B2 | * | 10/2009 | Elder et al. | 248/346.02 |
| 7,926,431 | B2 | * | 4/2011 | Morris | 108/57.25 |
| 2002/0077394 | A1 | | 6/2002 | Gugumus et al. | |
| 2002/0088379 | A1 | | 7/2002 | Phillips et al. | |
| 2003/0032708 | A1 | | 2/2003 | Scarlette | |
| 2003/0075840 | A1 | | 4/2003 | Hahn et al. | |
| 2003/0106470 | A1 | | 6/2003 | Apps et al. | |
| 2003/0110990 | A1 | | 6/2003 | Apps | |
| 2003/0136315 | A1 | | 7/2003 | Kim | |
| 2003/0183133 | A1 | | 10/2003 | Dehennau et al. | |
| 2003/0187102 | A1 | | 10/2003 | Medoff et al. | |
| 2004/0048055 | A1 | | 3/2004 | Branca | |
| 2004/0256385 | A1 | | 12/2004 | Hartwall | |
| 2005/0056193 | A1 | | 3/2005 | Laender et al. | |
| 2005/0166804 | A1 | | 8/2005 | Hansen | |
| 2005/0206029 | A1 | | 9/2005 | Moore et al. | |
| 2006/0081158 | A1 | | 4/2006 | Ingham | |
| 2007/0017423 | A1 | | 1/2007 | Ingham | |

FOREIGN PATENT DOCUMENTS

| | | | |
|---|---|---|---|
| FR | 2679482 | A1 | 1/1993 |
| GB | 2231552 | A | 11/1990 |
| WO | 02/00514 | A1 | 1/2002 |
| WO | 2006/074691 | A1 | 7/2006 |

OTHER PUBLICATIONS

Encyclopedia of Polymer, Sheet Molding Compounds, vol. 15, pp. 167-176.

Wikipedia of "Pallet", 6 pages, Oct. 4, 2007.

Altree: The Alternative to Trees, altree.com, 2 pages.

* cited by examiner

PALLET WITH LEAD BOARD

CROSS-REFERENCE TO RELATED APPLICATIONS

This application claims priority to U.S. Provisional Application Ser. No. 60/995,492, filed Sep. 26, 2007, and priority to U.S. Provisional Application Ser. No. 60/998,913, filed Oct. 12, 2007. The disclosures of the above applications are incorporated herein by reference in their respective entireties.

FIELD

The present disclosure relates to a pallet, and more particularly, a pallet having an improved lead board.

BACKGROUND

The statements in this section merely provide background information related to the present disclosure and may not constitute prior art.

The common wooden and plastic industrial pallets are generally known in the art. Such pallets, however, have several shortcomings in regard to cost, quality, limitations of their use, and ease of manufacture. Wooden pallets are typically constructed by sandwiching wooden block members between two similar decks or surfaces. Since the aesthetic appearance of pallets may not outweigh the cost, they may often include scrap or recycled wood. The surfaces may be made of a continuous sheet or, more commonly, have a plurality of wooden boards typically arranged in a parallel manner. Generally, the surfaces and blocks are stacked or arranged to provide apertures suitable for access by the tines of a forklift truck or pallet jack from at least one side. In certain instances, the tines of a fork-lift truck make contact with the lead boards of the decks and/or block members during alignment. If the force is significant, the lead boards and/or block members can be damaged.

By its nature, ordinary wood may be subject to swelling, warping, shrinkage, splintering, deterioration, and fungal or bacterial growth after exposure to moisture and other elements. Pallets assembled with inferior quality wood blocks and/or boards may lead to potential cargo damage.

Attempts to overcome the drawbacks of ordinary wooden pallets with plastic pallets have been faced with similar shortcomings. Prior designs of plastic pallets have had to deal with issues such as the trade off between cost and weight bearing capability. Typically, plastic pallets designed with a significant weight bearing capability have tended to be both heavy and expensive. In the same manner, inexpensive plastic pallets have had both strength and durability issues.

In recent times, society has expended significant efforts on continuing the development of more environmentally-friendly methods for reusing various synthetic and plastic materials. It is therefore desirable to provide a long-life pallet at least partially derived from recycled components and having outstanding physical attributes that is relatively inexpensive and can be manufactured with relative ease. Specifically, it is desirable to provide a low cost pallet that meets and exceeds stringent strength and design standards such that any damage from fork lift tines can be minimized or prevented.

SUMMARY

This section provides a general summary of the disclosure, and is not a comprehensive disclosure of its full scope or all of its features.

The present disclosure provides a pallet having an upper deck and a lower deck. The upper deck may include a plurality of board members. Supporting block members may be used to secure the upper and lower decks together to form a pallet. Such block members may comprise recycled or composite materials. The pallet may be provided with at least one lead board operable to serve as an energy attenuator. In certain embodiments, the lead board may comprise a composite material. The lead board may be separated or spaced apart from an adjacent board member by a gap or scallop type area and may be operable to flex inwardly or otherwise upon impact to absorb energy. In certain embodiments, the gap or scallop type area may be suitable to operate in combination with the lead board as a handle mechanism for grabbing or lifting the pallet. The lead board may also be used to attach shipping straps.

The composite material may include at least one recycled thermoplastic component such as a recycled nylon carpet material. In various embodiments, the composite material further includes at least one ground recycled material. In various aspects, the composite material may be manufactured with recycled components alone or combination with at least one prime or virgin material and may include natural materials.

The present disclosure also provides a pallet having at least one pultruded component, such as a pultruded lead board. In certain aspects the pultruded lead board may comprise unidirectional aligned fibers. In various other embodiments, at least one board member of the pallet may be encapsulated with a resin matrix material using pultrusion techniques to form a protective barrier and to absorb impact.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

Figure 1:
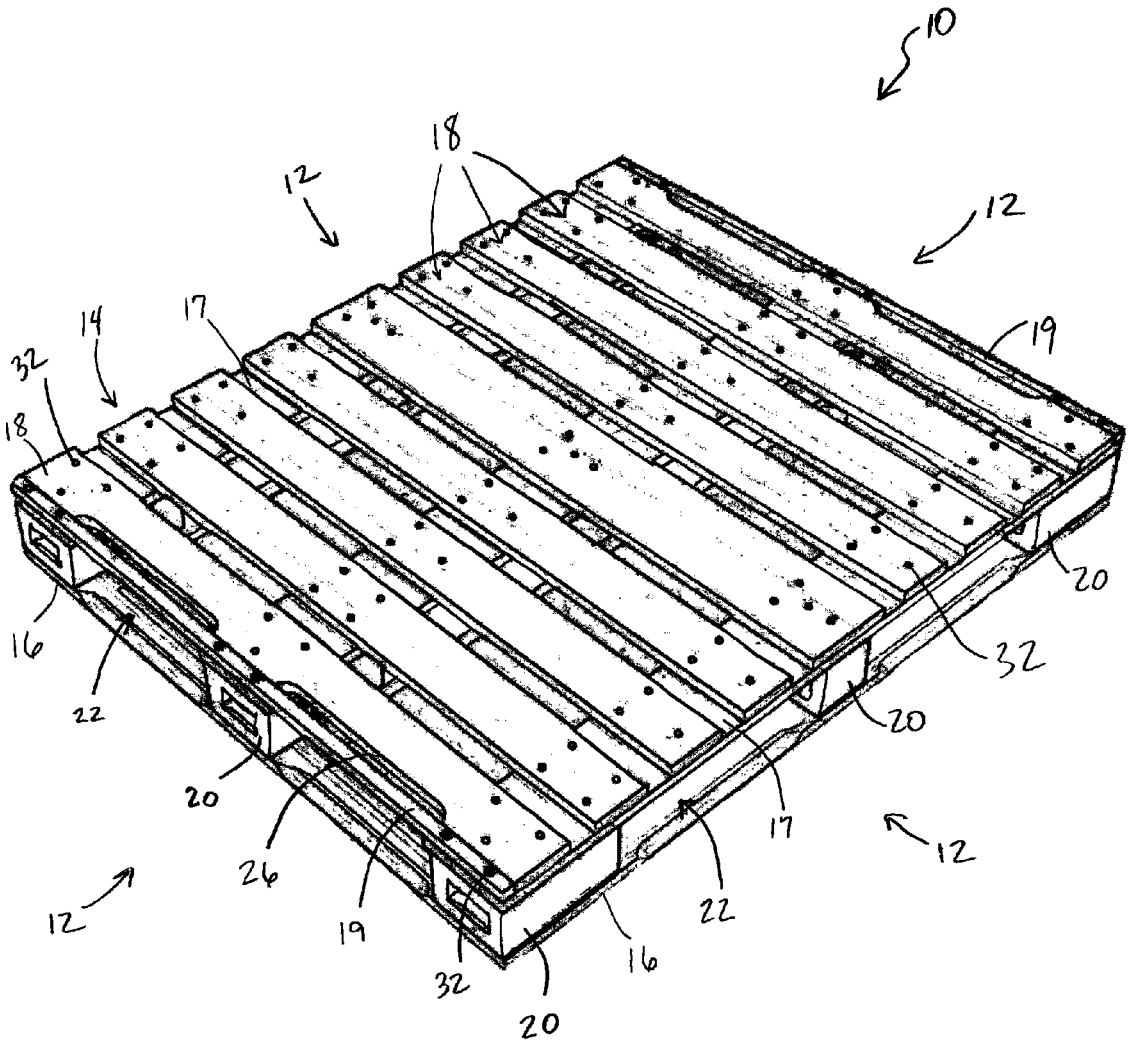
FIG. 1 is a perspective view of an exemplary pallet in accordance with teachings of the present disclosure.

It should be noted that the figures set forth herein are intended to exemplify the general characteristics of an apparatus, materials, and methods among those of this disclosure, for the purpose of the description of such embodiments herein. These figures may not precisely reflect the characteristics of any given embodiment, and are not necessarily intended to define or limit specific embodiments within the scope of this disclosure.

DETAILED DESCRIPTION

The following description of the present disclosure is merely exemplary in nature and is in no way intended to limit the disclosure, its application, or uses. For purposes of clarity, it should be understood that throughout the drawings, corresponding reference numerals indicate like or corresponding parts and features. Example embodiments will now be described more fully with reference to the accompanying drawings.

Figure 2:
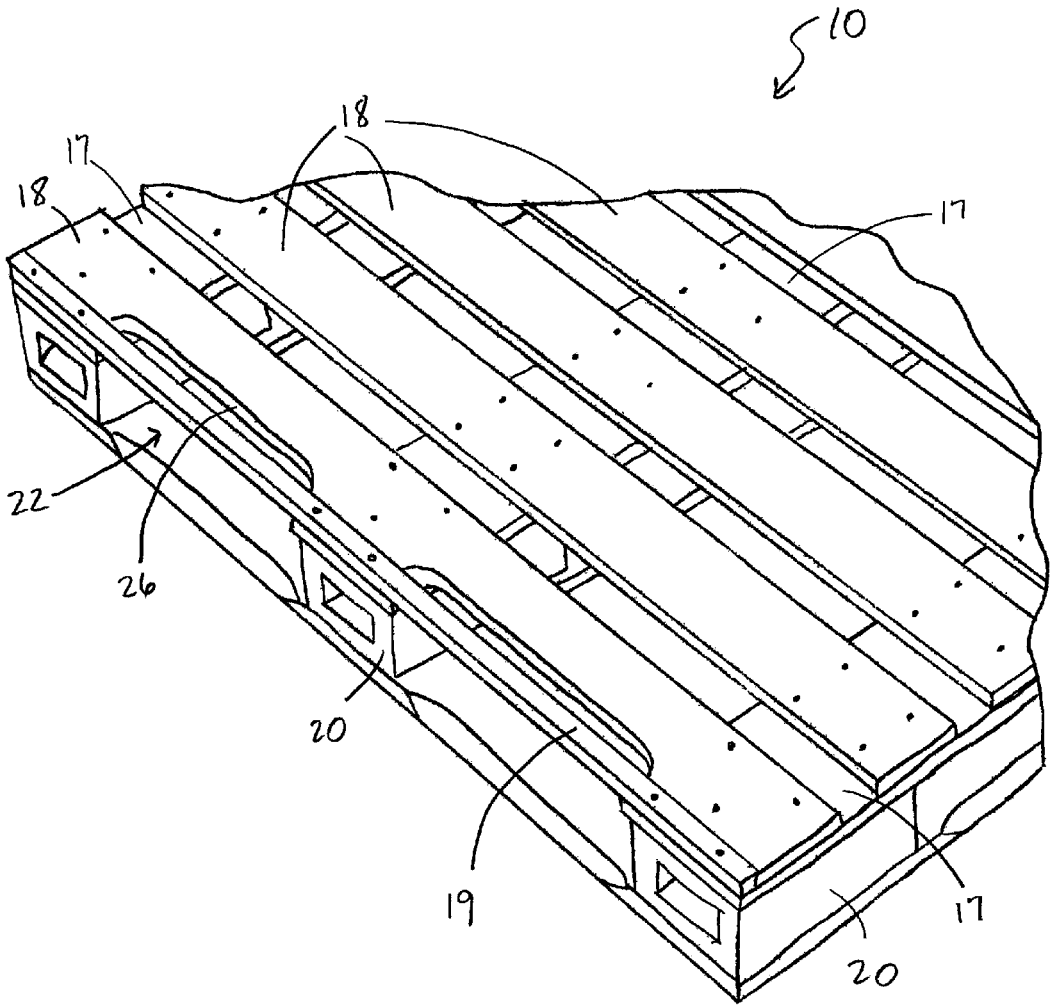
FIG. 2 is a partial magnified perspective view of the pallet of FIG. 1.

As shown in FIGS. 1 and 2, and generally referenced by the number 10, the pallet of the present disclosure has four peripheral sides 12, or edges, defining a perimeter. Preferably each side 12 is disposed at a substantially right angle, thereby forming a generally square or rectangular shape. In one embodiment, the pallet can be constructed having the industry standard size and dimensions, which is currently 40 inches wide by 48 inches long (1.0 m by 1.2 m), although it may be made in any desired size or shape. The pallet 10 includes an upper deck 14 and a lower deck 16, each preferably being formed of a plurality of longitudinally and laterally extending cross board members 18 and including one or more lead board members 19 typically disposed near the outer ends of the pallet 10. The cross board members 18 may be connected or secured via one or more connecting board members 17. In certain aspects, the various board members 17, 18, 19 may comprise more than one material, for example, more than one layer of material. The board members 17, 18, 19 may include wood and at least one layer of composite material. The layers may be fastened, secured, or bonded together, mechanically or as otherwise known in the art. In other aspects, the layers of materials may be formed via encapsulation techniques.

According to the principles of the present disclosure, at least one of the upper 14 and lower 16 decks may be provided with one or more energy attenuating lead board members 19. Such lead energy attenuating board members 19 are configured to protect the pallet 10 from contact with the tines of a forklift or the like. In various embodiments, the energy attenuating lead board member 19 resists permanent deformation and may be operable to withstand about 1,000 lbs of force from an incline test without damage to the lead board member 19 or other board members 17, 18 of the pallet 10. Thus, the present disclosure may serve to protect the inner board members by providing the pallet 10 with a stronger outer structure area, or defense system.

The present disclosure also provides protection to the connecting board members 17 in order to further offer increased bumper resistance. In certain aspects, the connecting board members 17 may be encapsulated with a resin matrix material using pultrusion techniques, as discussed in more detail below. Such a resin coating may serve to lessen some of the impact and stress that may be caused by contact with fork lift tines, or another brunt force. The encapsulated connecting board member may be provided with a layer of resin having a thickness from between about 1 to about 15 mm, and preferably between about 3 to about 7 mm. In certain aspects, one or more of the lead board members 19 and/or the cross board members 18 may be provided with such a resin coating or encapsulation with a resin matrix material.

Figure 3:
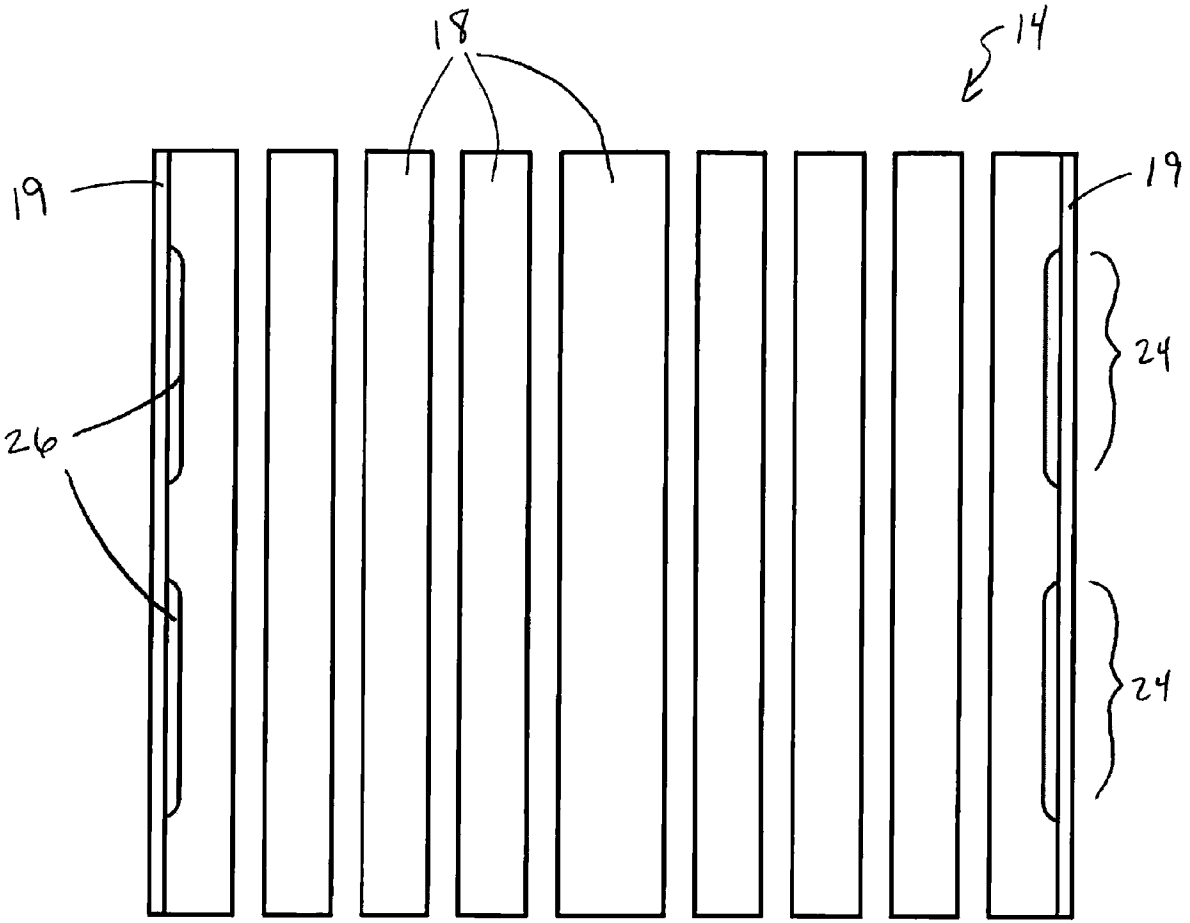
FIG. 3 is a top plan view of the board members of an upper deck of a pallet according to the present disclosure and showing individual components thereof.

With reference to FIG. 2, the energy attenuating lead board member 19 may be disposed substantially juxtaposed to a cross board member 18. As best shown in FIG. 3, at least a portion 24 of the lead board member 19 may separated from the adjacent cross board member 18 by a scalloped area, or gap, defining an aperture 26. This portion 24 of the lead board member 19 may be configured to flex or bend inward into the aperture 26 upon impact with the tines of a forklift or other handling device. Accordingly, the energy attenuating lead board members 19 may have a degree of flexibility and be operable to return to their original shape after impact. Such a design, with flexible lead board members 19, serves to absorb energy and protect the cross board members 18 and the connecting board members 17 from being chipped, cracked, or otherwise damaged from an impact such as that from a forklift. In various aspects, the cross board members 18 define the aperture 26. In other embodiments, the energy attenuating lead board members 19 may be provided with a scalloped area, or gap.

Figure 4:
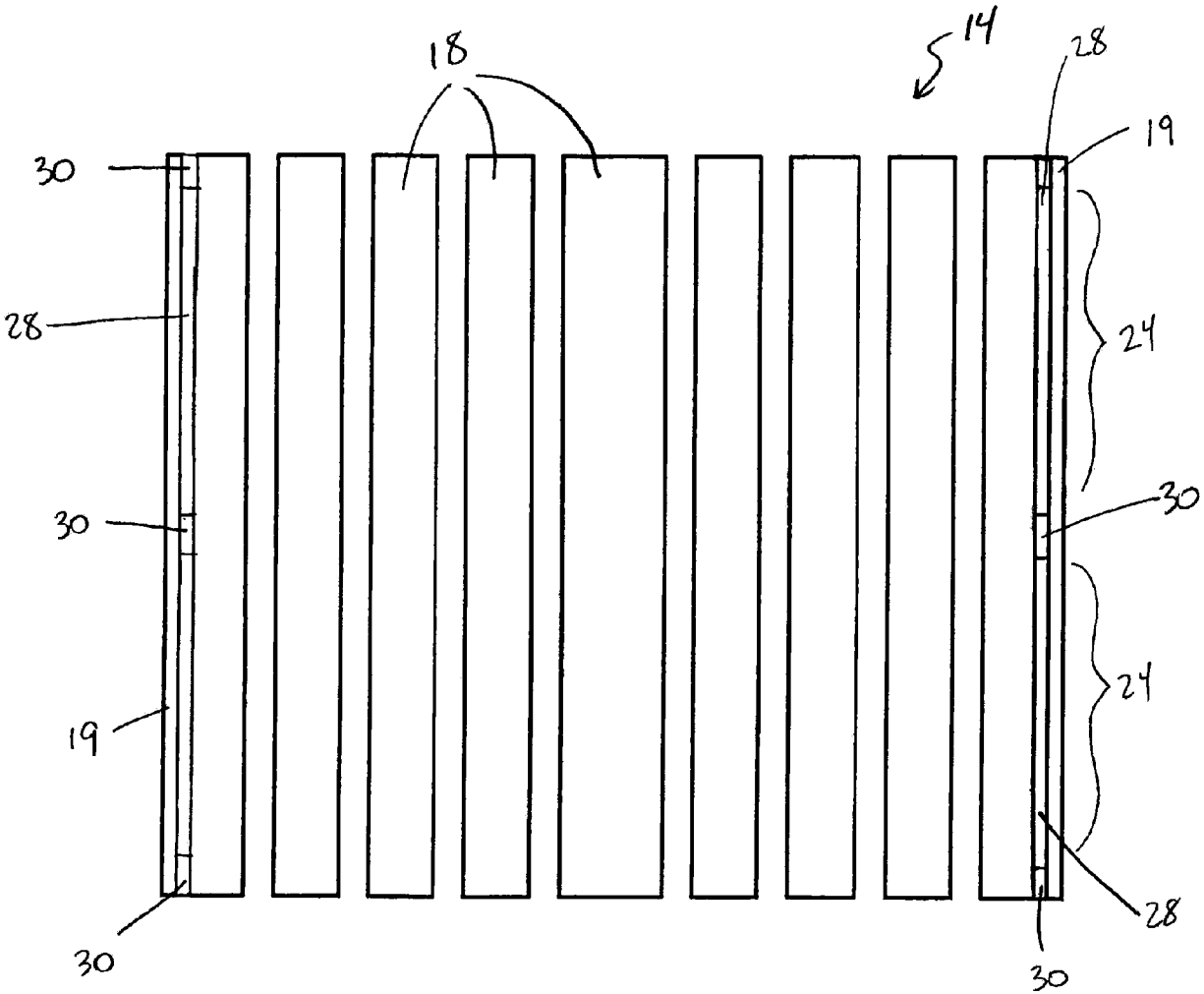
FIG. 4 is a top plan view of the board members of an upper deck of a pallet according to another embodiment and showing individual components thereof.

FIG. 3 illustrates a top plan view of board members 18, 19 of an upper deck 14 of one exemplary pallet 10 according to the present disclosure. FIG. 4 is a top plan view of another embodiment wherein the lead board member 19 is separated from the adjacent cross board member 18 by a predetermined distance, or gap 28. As shown, optional spacers 30 may be provided to separate the lead board member 19 from the cross board member 18. Such a design is contemplated to assist in the ability of the lead board member 19 to flex or bend and serve as an energy attenuator without compromising any of the mechanical fasteners, i.e., nails or screws, which attach the lead board member 19 to the other cross board members 18 of the upper or lower decks 14, 16.

In various embodiments, portions 24 of the lead board member 19 adjacent the gap 28 or aperture 26 may be suitable for use as a handle mechanism for grabbing or lifting the pallet 10. As such, the lead board member 19 may optionally be shaped with small indent areas (not shown) to provide a suitable gripping area. In certain embodiments, it is also envisioned that strap members or fasteners (not shown) may be used to secure the goods placed on the pallet 10 could be secured to these portions 24 of the lead board member 19.

In certain embodiments, the various cross board members 18 may have dimensions of between about 3½ to about 5½ inches wide, about 40 inches long and about 11/16 inches thick. Once assembled, the upper and lower decks 14, 16 are held together with a plurality of separating members, or block members, generally referenced by the number 20. As shown, the lead board members 19 may be smaller in size as compared to the other cross board members 18. In certain embodiments, the lead board members 19 are about ¾ inch wide. It should be understood that depending upon the material, the lead board members could range in width from about ¼ inch to about 1½-2 inches or more in order to provide suitable additional strength.

FIG. 2 depicts a partial magnified perspective view of the pallet 10 of FIG. 1, showing the lead board 19 substantially juxtaposed to a cross board member 18. As shown, at least a portion 24 of the lead board member 19 is separated from the nearest cross board member 18 by the scalloped area defining an aperture 26. As shown, the block members 20 hold the upper and lower decks 14, 16 together, while bearing and distributing the cargo loads placed on the upper deck 14. In various embodiments, the blocks 20 are mechanically fastened to the upper and lower decks, for example, with nails or screws 32. Preferably, there are nine blocks 20, aligned in three rows of three, defining two apertures 22 on each side 12 of the pallet 10. Ideally, each pallet has four corner blocks, four mid-side blocks, and one center block member. The size of the apertures 22 will depend upon the size and length of the block members 20.

In various embodiments, the upper deck 14 defines a generally planar load bearing surface upon which objects and goods may be positioned for transport and storage. The lower deck 16 defines a substantially planar bottom surface for the secure placement of the pallet on the ground or other resting surface. This also allows for the stable stacking of the pallet onto a similarly designed pallet. In certain embodiments, the upper and/or lower decks 14, 16 can comprise a continuous sheet of material (not shown) and having at least one energy absorbing lead board 19. In these embodiments, a number of indentations and projections such as ridges and channels (not shown) may be formed in the continuous portion of the top of the upper deck to allow for the drainage of any liquids that may accumulate thereon. Alternate embodiments may include further channels configured to direct fluid to the sides of the pallet if necessary. It should be noted, however, that the number, orientation, size and shape of any ridges or channels can be varied in many alternate configurations for optimized strength. Of course, the upper or lower deck 14, 16 may also have a continuous surface without drain apertures if so desired.

The load bearing surface may have a texture or an etched or imprinted geometrical pattern thereon (not shown) that acts as a non-skid surface to prevent objects from sliding during transport. Alternatively, any suitable type of friction tape or friction coating may be applied or laminated to the load bearing surface in order to help prevent movement of objects on the pallet. The final pallet assembly may additionally be embossed, silk screened, painted, or printed with indicia such as graphics, text, codes, brands, or the like if so desired.

Preferably, the lower deck 16 includes longitudinally and laterally extending cross-members aligned and connected to form a substantially rectangular or square shaped outer frame similar to that of the upper deck 14. Additional cross-members may be used, depending upon the desired load capacity of the pallet 10.

Preferably, the block members 20 are of a sufficient size so that the apertures 22 define a space suitable for access by the tines, or forks, of a forklift truck or pallet jack from any of the four sides 12 of the pallet 10. The size and number of apertures 22 will depend upon the placement and number of cross-members used. The current industry standard is to have apertures 22 with a separation distance D of about 3.5 inches between the upper deck 14 and lower deck 16. For additional impact resistance, the blocks 20 may be provided with curved ends, thereby minimizing potential damage which may occur upon collision or brunt contact. Depending upon the specific composite material and desired strength, small to medium size blocks 20 may vary in weight from about 0.5 to about 5 lbs or more, and preferably from about 1 to about 2 lbs, or about 1.5 lbs. The blocks 20 may have a volume of from about 25 to about 75 $in^3$ or more, and preferably from about 40 to about 60 $in^3$, or about 55 $in^3$. In other embodiments, it may be desirable to use larger scale blocks, for example having a volume of from about 75 to about 130 $in^3$ or more, and preferably from about 110 to about 125 $in^3$. These would typically have a weight of from about 4 to 5 lbs.

Figure 5:
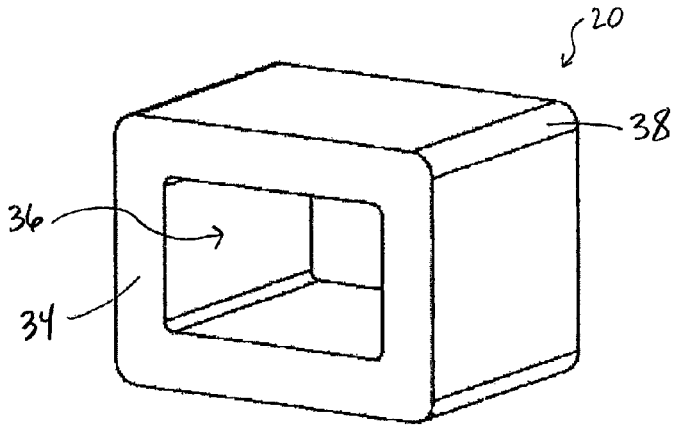
FIG. 5 is a perspective view of an exemplary block member comprising recycled material according to the present disclosure.
Figure 6:
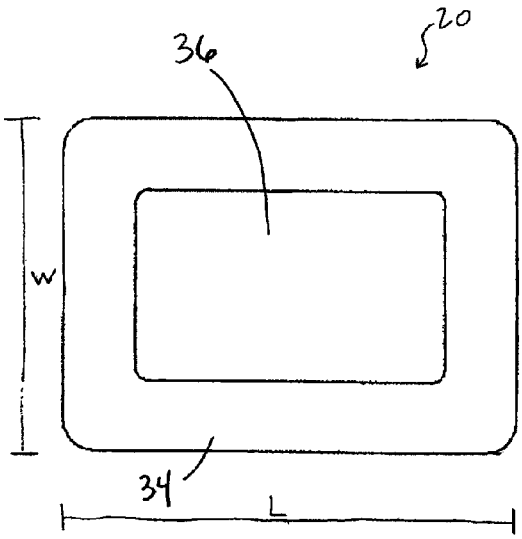
FIG. 6 is a front view of the block member of FIG. 5.
Figure 7:
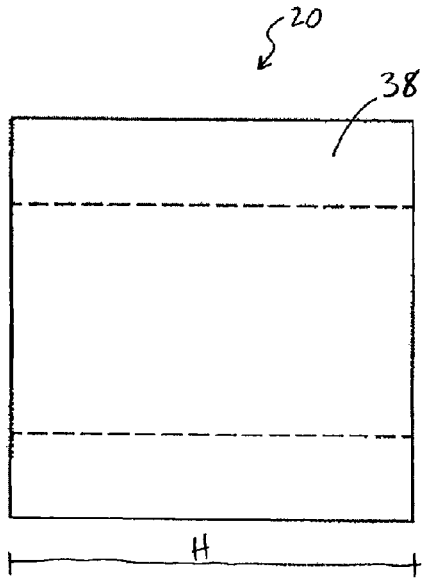
FIG. 7 is a side view of the block member of FIG. 5.

As shown in one non-limiting embodiment illustrated in FIGS. 5-7, a hollow block member 20 is provided with a substantially rectangular/square shape having at least one planar face 34 and a hollow center area 36. In various embodiments, the corner areas 38 may be slightly rounded if desired. In other designs, a solid block member may be used having a substantially rectangular/square top and cross-section and may have substantially rounded exterior corner areas. It should be understood that the block members 20 may be any shape suitable to provide the proper support between the upper 14 and lower 16 decks, including an elongated elliptical shape. They may also be provided with a plurality of alternating vertical channels and ridges (not shown). It should also be understood that the specific size and shape of the block members 20 may be modified as necessary and desired, and variations of the overall size and shape are within the scope of the present disclosure.

As previously mentioned, at least one of the block members 20, and optionally certain board members of the decks, such as the energy attenuating lead boards 19, comprise a high strength composite material. For example, in certain embodiments, the block members 20 comprise the composite material, and the cross board members 18 are standard wooden pieces. In other embodiments, the block members 20 and lead boards 19 comprise a composite material. In still other embodiments, each member of the pallet 10 may include at least a portion of composite material. It should be understood that numerous combinations and designs incorporating composite material blocks 20, composite cross board members 18, composite connecting board members 17, and composite energy attenuating lead board members 19 are possible, and all of the variations are within the scope of the disclosure.

The energy attenuating lead board members 19 may have various designs and can be manufactured using various methods of fabrication, depending on the desired uses. In various embodiments, the lead board members 19 may be created by forming a substantially elongated square, rectangular, or tube shaped member via a pultrusion manufacturing process. For example, a long pultruded member is cut to an appropriate length for secondary assembly to the pallet deck and/or the cross board members. In another embodiment, the lead board members 19 are created by first manufacturing a pultruded component having a channel, such as member having a substantially "C" shaped cross-section. The "C" is then cut to an appropriate length for secondary assembly to the pallet. In various aspects, the lead board members 19 are created by first manufacturing a "flat stock" pultruded sheet (not shown). These flat stock sheets can typically be many inches wide (for example, 48"). The flat stock sheet is then cut into the appropriate widths for secondary assembly to the main pallet component deck. In still another embodiment, the lead board members 19 can be created by manufacturing a special designed lineal pultrusion, having unique features such as tapered edges, if desired.

Pultrusion is a process known in the art used to typically create fiber reinforced polymeric composite materials that may include a thermosetting resin with reinforcing fibers therein. Various pultrusion compositions of the present disclosure include a thermosetting resin, various inert fillers, fiber reinforcements which typically consist of glass and veil mat fibers, a polymerization initiator, and lubricants.

The term "thermosetting resin", as used herein, refers to plastics (e.g., organic polymers) that are cured, set, or hardened into a permanent shape. Curing is an irreversible chemical reaction typically involving molecular cross-linking using heat or irradiation (e.g., UV irradiation). Curing of thermosetting materials can be initiated or completed at, for example, ambient or higher temperatures. The cross-linking that occurs in the curing reaction is brought about by the linking of atoms between or across two linear polymers, resulting in a three-dimensional rigidified chemical structure. Common resins may include urethanes, polyesters and vinyl esters. Resins may be selected depending on the specific pallet design, load capacity, and other requirements.

The reinforcing fibers that may be used according to the present disclosure include inorganic fibers, more preferably the fibers include glass fibers. The fibers include both individual fibers or rolls of fiberglass mats, or veils. One common fiber mat is woven roving material. The woven roving material may contain various grades of bidirectional, or weaved, organic and/or inorganic fibers. As used herein, the general term "fiber" refers to individual filaments, fibers and fiber bundles. Both individual fibers and fiber bundles can have a substantially greater width as well as height as compared to the individual filaments or fibers. Preferably, the woven roving comprises one of a high-strength fiber, a high-strength fiber in a polymer composite matrix, a high-strength fiber in a metal matrix, a high-strength metallic band, and a high-strength metallic wire.

Some non-limiting examples of inorganic fibers include E glass, S glass, high silica fibers, quartz, boron, silicon carbide, silicon nitride, alumina, and titanium carbide. Other materials for the woven roving layer include any and all pitch- and polyacrylonitrile (PAN)-based carbon fibers including standard modulus grades, intermediate modulus grades, high modulus grades, and ultra-high modulus grades. Some examples are Thomel P-25, Magnamite AS4, Torayca M30 and T1000, Magnamite IM7, Torayca M40J, Thornel P-55S; Torayca M60J; and Thornel P120. Additional materials for the woven roving layer include any and all grades of aramid, meta-aramid, and para-aramid fiber, for example Twaron, Kevlar 29, 129, 49, and KM2. Also, any and all grades of other polymeric fibers, for example, Spectra 900, Spectra 1000, Dyneema SK60, polyphenylene sulfide, polyetheretherketone, Vectran HS, Vectran M, polyimide, polyetherimide, and polyamide-imide. Also, any and all grades of polybenzimidazole-based fiber, including Zylon-AS and Zylon-HM. Also, any and all grades of metallic banding, wire, or fiber, including steel alloys, aluminum alloys, and titanium alloys.

Where the woven roving includes a composite material, the binding matrix may include any and all grades of thermosetting and thermoplastic polymers. Some examples include epoxy, polyester, vinyl ester, polyurethane, silicone, butyl rubber, phenolic, polyimide, bismaleimide, cyanate ester, polyetheretherketone, polyphenylenesulfide, polysulfone, polyethylene, polypropylene, polycarbonate, polyetherimide, polyethylenesulfide, acrylic, acylonitrile butadiene styrene, and nylon.

Various embodiments of the present disclosure may incorporate the use of high tensile strength glass filaments in the form of a woven roving material mixed in the resin. The fibers may be woven in a bidirectional pattern with untwisted roving strands, drawn in a substantially parallel orientation. In one embodiment, the energy attenuating lead board member 19 additionally includes uni-directional aligned fibers which extend substantially the entire length of main deck. Typical lengths of the continuous fibers may have a range of about 40 to about 48 inches, corresponding to the length and width of the pallet, respectively.

One embodiment includes at least one energy attenuating lead board member 19 constructed having continuous, uni-directional aligned reinforcing fibers which extend substantially parallel to and run along with the direction of the adjacent board members. The reinforcing fibers used for the deck and cross-members may contain a mixture of about 40-60% by weight continuous uni-directional fibers, and about 10-30% by weight veil mat or woven roving. The continuous, uni-directional fiber alignment provides exceptional strength and support, and increases the stability and load bearing strength. In addition, the fiber combination and alignment may provide superior material properties such as a compressive strength greater than 200 MPa, a flexural strength greater than 200 MPa, a flexural modulus greater than 10 GPa. The thickness and density of the pultruded materials may be varied depending on the load characteristics and strength requirements of lead board member 19 and the pallet 10 as a whole.

The pultrusion process may involve pulling raw materials through a heated steel forming die using a continuous pulling device as known in the art. According to one preferred method, reinforcement materials such as continuous strands of glass, woven roving or fiber mat veil are oriented as desired through a guide plate into a preferred formation. The fibers are then saturated and combined with a resin matrix by a resin impregnator. The saturated resin mixture includes resin, fillers, pigment, and catalyst in addition to any other additives as required. The resin impregnator optimizes the complete saturation of the fiber reinforcements and feeds the material into an array of tooling that removes excess resin and shapes the material prior to entering a die. Once in the die, and under proper heat, the glass/mat resin matrix polymerizes with the thermosetting resin forming a deck or pallet component with uni-directional fibers extending parallel along the longitudinal axis. For example, a component may be pulled through a rectangular frame die to form a monolithic, pultruded lead board member 19. The pultruded member is preferably formed with one die, although multiple dies and construction options could be employed.

In various embodiments, the composite materials used in the manufacture of pallet components may include at least one recycled thermoplastic component, and can include at least 20% by weight of a recycled nylon carpet material. The recycled nylon carpet material particles may be present in an amount up to about 50% by weight, or up to about 75% or even 90% by weight, including a major portion of nylon 6 and/or nylon 6,6 depending on the specific design. In various embodiments, such nylon material is provided in an amount from about 80% to about 85% by weight. The composite material has excellent resistance to chemicals, including strong solvents, and is not moisture or odor absorbent. Such composite blocks and/or cross member boards containing recycled materials according to the present disclosure are robust and rugged in construction, configured to withstand the weight of goods stacked on them and to withstand the impact of truck forks driven into them as a result of misalignment. A pallet comprising such composite material also has the capability of being fitted with RFID technology.

Various conventional nylon based carpeting useful with the present disclosure typically includes at least three primary components, namely a plurality of tufts formed from nylon, at least one backing typically formed from polyolefins such as polypropylene, and an adhesive material applied as a latex and typically filled with an organic filler such as calcium carbonate. In various embodiments, the nylon tufts include a major portion of nylon 6; nylon 6,6; or blends or copolymers thereof. While this multi-component carpet product may present challenges to typical recycling efforts due to the varying chemical and physical characteristics of its individual components in different forms, such nylon containing carpet, both new and used, is useful in the preparation of a composite material for use in a pallet according to the present disclosure. If desired, various methods are known in the art useful for converting an "unseparated" carpet into a thermoplastic material formed from a melt blend of the materials which originally comprised the carpet. For example, U.S. Pat. No. 5,294,384 to David et al. which is incorporated herein by reference in its entirety, discloses a process for forming a thermoplastic composition from carpet wherein a carpet sample is melted and blended without separating the carpet into its various parts.

The composite material may also include various plastic materials in addition to that in the recycled nylon carpet. As used herein, "plastic material" includes, but is not limited to, plastic materials suitable for use in a high strength composite material for a pallet, such as thermoplastic polymers resistant to many chemical solvents, bases and acids, for example, polypropylene, polyethylene, polyurethane, polyvinylchloride, and poly(ethylene terephthalate). The plastic material may also include various types and grades of nylon, such as nylon 6 and nylon 6,6. Recycled nylon can be obtained from many industrial type sources, for example from automotive uses, such as nylon gears; rubber textiles; and rubber fabrics. The plastic may be selected depending on the specific pallet design, load capacity, and other requirements. In various embodiments, the block members may be manufactured with either recycled components alone or combination with at least one prime or virgin material. Thus the composite material may include various grades of virgin plastic, recycled plastic, and mixtures thereof.

In various embodiments, the composite material of the present disclosure comprises at least 20% by weight of recycled nylon carpet material. In one embodiment, the composite material includes a major portion of nylon 6 and nylon 6,6, for example up to about 50% by weight, in some embodiments, up to about 80% by weight. According to other embodiments detailed below, the composite material may comprise greater than about 20% by weight of natural material particles, or greater than about 50% by weight, or even greater than 80% by weight. It should be understood that all weight percentages described herein can be increased or decreased between 0% and 100% for a desired composite material, depending on the specific design and selection of materials, and these variations are within the scope of the present disclosure.

In various embodiments, the composite material may further include at least one ground recycled material selected from the group consisting of bottling containers, automotive rubber and plastic components, agricultural films, rubber and rubber tires, fabrics, textiles, reclaimed paper, sanitary paper products, and mixtures thereof. In various embodiments, the block members may be manufactured with such recycled components alone or combination with at least one prime or virgin material. In most instances, the recycled materials are shredded prior to use, as opposed to being in their original size and shape. Shredding would include any type of cutting, grinding, chopping, or other reducing operation that cuts or tears apart recyclable materials, or any portion thereof, to create smaller pieces for use in the composite material of the present disclosure.

As used herein, bottling containers may include typical recycled fluorinated plastic containers or PET type containers including, for example, those commonly used to store and/or transport various liquids. Automotive rubber and plastic components may include any and all suitable recyclable materials derived from automobiles and/or automotive equipment. Rubber includes industrial rubber compounds, such as those typically derived from polystyrene, polybutadiene, and poly (styrene-butadiene-styrene) or SBS. "Rubber tires" generally refers to vehicular tires of the type used by automobiles, tractors, etc.

As used herein, an "agricultural film" generally includes, but it not limited to, a film formed from polyvinyl chloride (PVC), polycarbonate (PC), a polyethylene thermoplastic resin, such as polyethylene (PE), low density polyethylene (LDPE), or an ethylene-vinyl acetate copolymer, or other such suitable films formed from a polyester resin that may be used for forming, for example, a greenhouse or a plastic tent, since such films exhibit excellent transparency, heat-insulating ability, and mechanical strength. These resin type films typically cannot be used for their intended purpose for a long period of time because of deterioration caused by UV rays, for example, impairment of transparency or breakage of the film. Thus, they may be suitably cleaned and shredded prior to being used in the recycled composite material of the present invention.

The composite material may also include paper stock, reclaimed "waste" paper (so-called recycled papers), de-inked paper stock, paper shavings or cuttings, and the like. The reclaimed papers may be shredded and included "as-is" or may otherwise be mechanically disintegrated in water to produce a pulp suspension, after which foreign materials may be removed. De-inked paper stock may be used from printed and/or unprinted reclaimed papers by means of mechanical disintegration, and may be treated with chemicals and dispersing agents. In general, certain secondary pulps may be of shorter fiber length and somewhat lower in strength than the original pulp; therefore, they may be used either alone or combination with prime or virgin fibers. Paper shavings and cuttings (e.g., from binderies) may also be used.

In various embodiments, the composite material may include recycled sanitary paper products. As used herein, "sanitary paper products" may include various absorbent sanitary products, such as disposable baby diapers, that can be separated into such products suitable for use as a recycled material. Numerous treatment processes for recovering usable portions of such items are known in the art. For example, U.S. Pat. No. 5,558,745 to Conway et al. discloses a treatment process for separating components suitable for recycling from absorbent sanitary papers products and is incorporated herein by reference in its entirety.

As previously discussed, the composite material of the present disclosure may include a natural material, such as wood, its shavings, or mulch in addition to the recycled nylon carpet and other materials. As used herein, a "natural material" typically includes wood, for example, material from a tree, including but not limited to leaf material, branch material, trunk material, bark material, needle material, and root material. As used herein, the term "wood" includes, but is not limited to, any hard and soft wood trees, and includes wood particles, fibers, strands, dust, scraps, and products made there from. The wood particles used in the present disclosure may be elongated shapes having a width or average particle size that is about ¼ (0.25) inch or less. In various embodiments, the width is 1/16 (0.0625) inch or less, and even more preferably, 1/32 (0.03125) inch or less. It should be understood that the average particle size can be increased or decreased, depending on the specific design and selection of materials, and these variations are within the scope of the present disclosure. It should further be noted that the average particle size is not based on the total number of particles but rather is based on the weight percentage of the material retained in measuring sieve trays in relation to the total sieved material weight. Natural material particles often have unequal dimensions, for example a length greater than a width. In such circumstances, a particle size refers to at least one dimension having the specified size. Particle size distribution can be determined using Gaussian distribution, or other methods known in the art.

Optional non-limiting additives for the composite material may include colorants, UV protectors, flame and fire retardants, lubricants, soaps, various inert fillers, reinforcements (including, for example, natural, synthetic, and glass fibers), polymerization initiators, coupling agents, and other additives known in the art. Foaming agents may also be used to reduce overall mass and save on raw materials and weight. Additionally, the composite material is recyclable to itself as filler. In particular, the use of coupling agents in the composite matrix may improve thickness swell and increase the resistance to UV exposure and surface popping. Coupling agents increase the bond between the natural and plastic materials which typically increases the stiffness and strength by up to about 30%. Alternatively, if it is not desirable to use a coupling agent, the average particle size can be slightly decreased to maintain an equivalent strength.

In certain embodiments, and preferably where the composite material is used to manufacture sheet boards that are subsequently cut into lead boards, it may be desirable to use larger size recycled particles and include the use of reinforcing natural or wood fibers. Such fibers may be used having an average length of about ⅜ inch, ½ inch, ¾ inch, or even greater as desired. In various embodiments, it may also be desirable to include continuous, uni-directional reinforcing fibers, such as silicon-based fiberglass or other inorganic or organic fibers. These continuous fibers would extend substantially parallel to and run along with the direction of the board members to provide additional strength.

The wood particles may be processed in a hammer mill using a desired screen size. This enables distribution of the wood material product in a substantially even manner for use with the recycled components in the composite material. In various embodiments, the particles have a random orientation in the final product, although with some embodiments using extrusion techniques it may be desired to have a process-specific orientation. Further, if reinforcing fibers are used, it may be desired to align the fibers for increased strength.

The manufacture of the composite material of the present disclosure into various geometries is preferably achieved using typical press methods, compression, injection molding, and/or extrusion techniques known in the art. In certain embodiments, the lead board member is extruded. If natural materials are used, i.e., wood or natural fibers, they are typically first passed through a mill to obtain a desired particle size. The recycled and/or virgin plastic materials are provided in a form suitable for mixing with the natural materials, for example, in the form of a fluid, pellet, flake, powder, or the like. In certain embodiments, the particles are pre-densified before use. As will be discussed in more detail, in one embodiment, the composite material is manufactured having a board or panel geometry suitable for use as cross members and/or lead board members for the upper and/or lower deck of the pallet. In another preferred embodiment, the composite material is manufactured having a block or post geometry for use as supporting blocks that join the upper and lower decks to one another.

Typical press methods, if optionally used, rely on at least one press and include suitable pneumatic, mechanical and/or hydraulic presses that process wood/plastic mixtures into, for example, a block or a composite board. As is known in the art, a press typically includes an upper platen and a lower platen. At least one platen is driven upward or downward by a drive mechanism. A composite material assembly is positioned between the upper and the lower platens. A typical composite material press assembly may include a lower caul plate, a frame, the composite mixture and an upper caul plate. According to one embodiment of the present disclosure, at least one of the platens is heated to a temperature sufficient to melt the plastic component of the composite material. Heating of the platen(s) occurs optionally before or after engagement of the drive mechanism. In one embodiment, both platens are heated prior to application of pressure to the composite mixture. Preferably, the drive mechanism drives the lower platen upwards until the upper platen contacts the upper caul plate and compresses the composite mixture.

The plastic components of the composite material mixture may melt from the heat and disperse throughout the discontinuous wood phase. The composite material may essentially form a slurry of liquid plastic and wood particles. Preferably, air (and any other gas that may be present) exits the composite mixture during this process or it is alternatively compressed and trapped within the slurry. The slurry is typically of a density greater than that of the composite mixture and occupies a lesser volume than the mixture. The slurry may then be cooled and forms a relatively rigid composite product, such as a board. Rigidity and strength of the final product will depend upon the thickness, the type of plastic used, the ratio of natural and plastic materials, the amount and pressure of any entrained gas, and whether a reinforcing material, such as rods, bars, organic or inorganic continuous fibers, or a mesh, is incorporated into the slurry. It should be understood that caution is required when positioning the materials into the press to avoid segregation of the wood and plastic materials. Minimized segregation often forms a higher quality composite board.

In certain embodiments, any wood preparation methods and press and/or extrusion methods can be combined into one production process. For example, a wood receiver can be used for receiving wood that is transported to a screen for screening out undesirable larger pieces of wood. Once screened, the wood may be transported to a reducer for reducing the size of the screened wood. The reduced wood may be transported to a washer and/or screener that can optionally include a re-chipper for further reduction of the screened wood particle size. Next, the washed wood may be flaked using an appropriate flaker and transported to a flake receiver that optionally includes a heater and/or dryer and/or a dust burner. Flakes may then be transported to a grinder for grinding and/or sizing of the wood. The ground wood is then transported to a sifter for sifting fines from larger pieces of wood. Fines are transported to and stored in a fines receiver while the larger pieces are transported to and stored in a processed wood receiver. The fines receiver and processed wood receiver can optionally use filters. The processed wood and/or fines are then ready for further processing and/or combination with the recycled and/or plastic components.

Recycled and/or plastic materials typically enter the production process through a secondary receiver. The materials in a secondary loader are optionally transported to a storage receiver for storage and/or further processing. The storage receiver optionally includes a filter. Once the recycled and/or plastic material has been processed and/or stored, it is then transported to a measurement system, for example, a weigh station system and/or flow measurement system. The recycled materials, wood, and/or plastic may be transported to a blender for blending the components together. The blended components may be transported to a production line that includes a press and/or an extruder. The production line produces a final product or optionally has additional equipment for performing additional steps for producing the final product. For example, the production line can optionally include an unloader and/or cooler; at least one trimmer and/or borer; at least one transfer and/or inspection unit; a sander; a paint unit, for example, for spray painting (if desired); an oven, for example, for curing paint and/or other coating material; a grade station; and/or a stacker, for stacking product.

What is claimed is:

1. A pallet comprising:

a first deck;

a second deck; and a plurality of block members connecting the first and second decks together to form a pallet, wherein at least one of the first and second decks comprises a substantially rectangular frame having at least one flexible, energy attenuating lead board member and a plurality of longitudinally and laterally extending cross board members, the lead board member extending and in contact with an adjacent cross board member wherein at least a portion of the lead board member is separated from the adjacent cross board member, defining an aperture including a scalloped area allowing the lead board member to flex or bend into upon impact.

2. A pallet according to claim 1, wherein the lead board member is formed using pultrusion techniques.

3. A pallet according to claim 2, wherein the lead board member is integrally formed from a monolithic piece of pultruded material.

4. A pallet according to claim 3, wherein the pultruded material comprises a fiber reinforced thermosetting resin including at least one of a glass mat, fiber mat, and woven roving material.

5. A pallet according to claim 2, wherein the pultruded material comprises a mixture of about 40 to about 60% by weight of continuous uni-directional fibers and from about 10 to about 30% by weight of veil mat or woven roving material.

6. A pallet according to claim 1, wherein at least one block member and at least one cross board member comprises a recycled material selected from the group consisting of bottling containers, automotive plastic components, agricultural films, rubber tires, fabrics, textiles, reclaimed paper, sanitary paper products, and mixtures thereof.

7. A pallet according to claim 1, further comprising at least one connecting board member configured to connect the cross board members.

8. A pallet according to claim 7, wherein at least one of the lead board member, cross board members, and connecting board member is encapsulated with a resin matrix material.

9. A pallet comprising:

an upper deck comprising a plurality of cross board members and at least one energy attenuating lead board member disposed adjacent to and in contact with one of the cross board members;

a lower deck; and a plurality of block members connecting the upper and lower decks together to form a pallet, wherein at least a portion of the lead board member is separated from the adjacent cross board member defining a scalloped area to allow for deformation of the lead board member, the lead board member being configured to flex upon impact and return to its original shape without permanent deformation.

10. A pallet according to claim 9, wherein the lead board member comprises a monolithic piece of pultruded material.

11. A pallet according to claim 9, wherein the lead board member comprises continuous, uni-directional reinforcing fibers.

12. The pallet according to claim 9, further comprising a connecting board member configured to connect a plurality of the cross board members to one another, wherein at least one of the lead board member, cross board members, and connecting board member is encapsulated with a resin matrix material.

13. A pallet comprising:

a first deck including a plurality of longitudinally and laterally extending cross board members;

an energy attenuating lead board member extending and in contact with an adjacent one of the cross board members; and a second deck connected to the first deck to form a pallet, wherein at least a portion of the lead board member defines a scalloped shaped aperture and is separated from the adjacent one cross board member allowing the lead board member to flex upon impact.

14. The pallet according to claim 13, wherein the lead board member is integrally formed from a monolithic piece of pultruded material.

15. The pallet according to claim 13, wherein the lead board member is encapsulated with a resin matrix material having a thickness from about 1 to about 15 mm.

16. The pallet according to claim 13, wherein the lead board is configured to flex upon impact of up to 1,000 $lb_f$ and return to its original shape without permanent deformation.

17. The pallet according to claim 13, wherein the lead board member comprises continuous uni-directional aligned fibers extending its entire length.

* * * * *